US012083572B2

(12) United States Patent
Akiba et al.

(10) Patent No.: US 12,083,572 B2
(45) Date of Patent: Sep. 10, 2024

(54) PRESS MOLDING METHOD

(71) Applicant: HONDA MOTOR CO., LTD., Tokyo (JP)

(72) Inventors: Hirokatsu Akiba, Tochigi-ken (JP); Takeshi Sano, Tochigi-ken (JP); Kenji Matsutani, Tochigi-ken (JP); Takayuki Kano, Tochigi-ken (JP)

(73) Assignee: HONDA MOTOR CO., LTD., Tokyo (JP)

( * ) Notice: Subject to any disclaimer, the term of this patent is extended or adjusted under 35 U.S.C. 154(b) by 406 days.

(21) Appl. No.: 17/439,422

(22) PCT Filed: Mar. 3, 2020

(86) PCT No.: PCT/JP2020/008793
§ 371 (c)(1),
(2) Date: Sep. 15, 2021

(87) PCT Pub. No.: WO2020/195591
PCT Pub. Date: Oct. 1, 2020

(65) Prior Publication Data

US 2022/0152682 A1 May 19, 2022

(30) Foreign Application Priority Data

Mar. 28, 2019 (JP) ..... 2019-063176

(51) Int. Cl.
*B21D 22/26* (2006.01)

(52) U.S. Cl.
CPC ..... *B21D 22/26* (2013.01)

(58) Field of Classification Search
CPC ..... B21D 22/02; B21D 22/21; B21D 22/22; B21D 22/24; B21D 22/26; B21D 22/30; B21D 24/005; B21D 53/88
See application file for complete search history.

(56) References Cited

U.S. PATENT DOCUMENTS

2009/0272171 A1* 11/2009 Golovashchenko ... B21D 26/02 72/347
2010/0018280 A1 1/2010 Maeda et al.
(Continued)

FOREIGN PATENT DOCUMENTS

DE 102011115219 3/2013
JP 2006026638 A * 2/2006 ..... B21D 51/26
(Continued)

OTHER PUBLICATIONS

Indonesian Office Action for Indonesian Patent Application No. P00202109024 dated Apr. 6, 2023.
(Continued)

*Primary Examiner* — Debra M Sullivan
*Assistant Examiner* — Matthew Stephens
(74) *Attorney, Agent, or Firm* — Amin, Turocy & Watson, LLP

(57) ABSTRACT

Provided is a press molding method in which a plate material is molded into a target molded body including a ridge section, said method including: a first step for molding an intermediate molded body; and a second step for forming the target molded body from the intermediate molded body. The target molded body and the intermediate molded body have coincident regions where the cross-sectional shapes coincide on both sides of an intermediate ridge section, and an intermediate region where the cross-sectional shapes do not coincide. The intermediate region includes: an outer region in which the intermediate molded body protrudes outward of an edge radius with respect to the target molded body; and an inner region in which the intermediate molded body is curved inward of the edge radius with respect to the target molded body.

10 Claims, 8 Drawing Sheets

(56) References Cited

U.S. PATENT DOCUMENTS

| | | | | |
|---|---|---|---|---|
| 2011/0016945 | A1* | 1/2011 | Nakao | B21D 35/006 72/358 |
| 2019/0351473 | A1* | 11/2019 | Stammen | B65D 7/36 72/358 |
| 2020/0338618 | A1 | 10/2020 | Akiba et al. | |

FOREIGN PATENT DOCUMENTS

| | | | | |
|---|---|---|---|---|
| JP | 5959702 | | 8/2016 | |
| JP | 5959702 | B1 * | 8/2016 | B21D 22/26 |
| JP | 2017-030038 | | 2/2017 | |
| WO | 2008/047764 | | 4/2008 | |
| WO | 2016/087014 | | 6/2016 | |
| WO | 2019/102972 | | 5/2019 | |

OTHER PUBLICATIONS

Indian Office Action for Indian Patent Application No. 202147048888 dated Mar. 31, 2022.

International Search Report and Written Opinion for International Application No. PCT/JP2020/008793 mailed on Jun. 9, 2020, 9 pages.

* cited by examiner

PRESS MOLDING METHOD

TECHNICAL FIELD

The present invention relates to a press forming method (press molding method) for forming a plate member into a predetermined shape.

BACKGROUND ART

Outer panels such as automobile hoods, side panels, and door panels or the like are generally produced by press forming of a plate member made of metal. The outer panel is a component part that determines the design of an automobile. For example, a design having a ridgeline section with a small radius of curvature referred to as a character line is used. An advanced press forming technique is required in order to form outer panels of this type.

In DE 102011115219 A1, there is disclosed a press forming method for a plate member in which, using a first die, a ridgeline section (also referred to as an edge portion) is preliminarily formed and sections other than the ridgeline section are formed into a final shape, and next, using a second die, the ridgeline section is formed into a final shape. A radius of curvature (also referred to as an edge radius) of the ridgeline section formed by the first die is on the order of 2 to 10 times the size of that in the final shape, and is formed into a predetermined size by a deep drawing process in the second die.

In JP 5959702 B1, a method is disclosed for producing a formed product having a ridgeline section by a two stage pressing process. JP 5959702 B1 discloses a method of preventing line displacement, by setting an intermediate shape formed by a first stage pressing process so as to project more outwardly than the shape of a target formed body formed by a second stage pressing process.

SUMMARY OF INVENTION

In the press forming method according to the aforementioned DE 102011115219 A1, because the drawing process is performed in two stages, it is difficult for surface distortion to occur. However, the elongation of the ridgeline section becomes large, and if an attempt is made to form the ridgeline section with a small radius of curvature (edge radius), cracks may be disadvantageously generated in the ridgeline section. Further, in the press forming method of the above-described JP 5959702 B1, since the second stage forming is performed in a state in which a tensile force is relieved, a concern arises in that surface distortion may occur.

Therefore, an object of the present invention is to suppress both the occurrence of cracks and the occurrence of surface distortion, in a press forming method for forming a ridgeline section having a small radius of curvature by a two stage drawing process.

One aspect of the present invention is characterized by a press forming method for forming a plate member into a target formed body in which a ridgeline section is included, the press forming method comprising a first step of forming an intermediate formed body including an intermediate ridgeline section with a radius greater than an edge radius of the ridgeline section, and a second step of forming the target formed body from the intermediate formed body, wherein the target formed body and the intermediate formed body each include coincident regions in which cross-sectional shapes thereof coincide on both sides of the intermediate ridgeline section, and an intermediate region in which the cross-sectional shapes thereof do not coincide, and include, in the intermediate region, an outside region in which the intermediate formed body projects more outwardly of the edge radius than the target formed body, and an inside region in which the intermediate formed body is curved more inwardly of the edge radius than the target formed body.

According to the press forming method of the above-described aspect, even in the case that a ridgeline section having a small radius of curvature is formed, it is possible to suppress both the occurrence of cracks and surface distortion.

DESCRIPTION OF EMBODIMENTS

Hereinafter, a preferred embodiment of the present invention will be presented and described in detail with reference to the accompanying drawings. Moreover, in the description given below, a top dead center side in a press stroke direction is referred to as an "upper side," and a bottom dead center side is referred to as a "lower side."

Figure 1B:
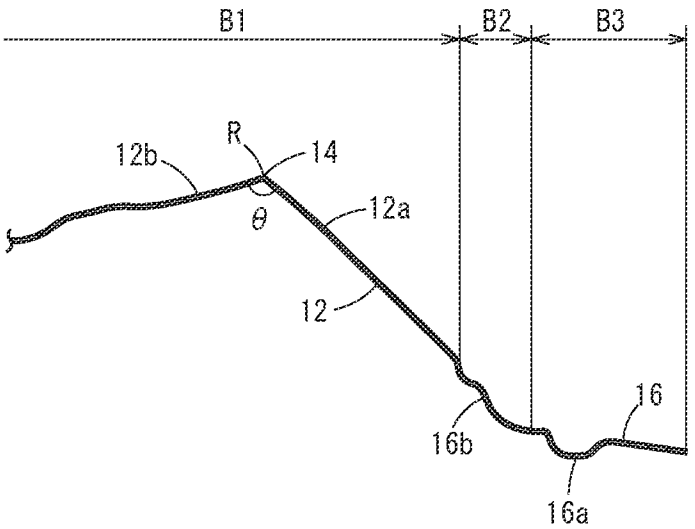
FIG. 1B is a cross-sectional view taken along line IB-IB of FIG. 1A.
Figure 1A:
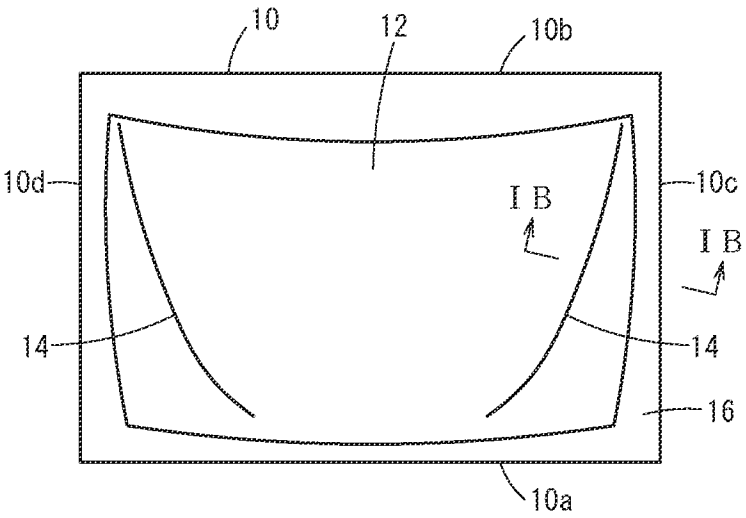
FIG. 1A is a plan view showing an example of a target formed body that is formed by a press forming method according to an embodiment of the present invention.

The press forming method according to the embodiment is applied, for example, to an automobile hood, side panel, door panel, or the like. In this instance, as shown in FIG. 1A, a description will be given of an example of forming a rectangular plate member 10. The plate member 10 is made, for example, from a thin plate metal such as steel or an aluminum alloy having a thickness of 0.3 mm to 3 mm. The outer peripheral portion of the plate member 10 is formed in a quadrangular shape constituted by a first side 10*a*, a second side 10*b* facing toward the first side 10*a*, a third side 10*c* extending in a direction intersecting the first side 10*a*, and a fourth side 10*d* facing toward the third side 10*c*. As shown in a first step of FIG. 2 and a second step of FIG. 3, a target formed body 12 is obtained by press forming the plate member 10 in two stages.

In the target formed body 12, a surface thereof appearing in FIG. 1A serves as a design surface. Such a design surface corresponds to an upper surface shown in FIG. 1B. As shown in FIG. 1A, on the upper surface of the target formed body 12, ridgeline sections 14 (also referred to as character lines) are formed in edge-like shapes in the vicinity of the third side 10*c* and in the vicinity of the fourth side 10*d*, and extend from the first side 10*a* toward the second side 10*b*. As shown in FIG. 1B, a radius of curvature R (also referred to as an edge radius) of each of the ridgeline sections 14 in a cross-section perpendicular to the direction of the ridgeline section 14 is formed to be small, i.e., from 2.5 mm to 9 mm, and exhibits a sharp blade-like external appearance.

In the target formed body 12, a first slope 12*a* is formed on one side portion of the ridgeline section 14, and a second slope 12*b* is formed on the other side portion of the ridgeline section 14. In this instance, the slope in closer proximity to a peripheral portion 16 is referred to as the first slope 12*a*, whereas the slope farther away from the peripheral portion 16 is referred to as the second slope 12*b*. The first slope 12*a* and the second slope 12*b* may be positive surfaces that are convex when the design surface is viewed from the front, or may be negative surfaces that are concave when the design surface is viewed from the front. An angle θ (also referred to as a sandwiching angle) formed by the first slope 12*a* and the second slope 12*b* can be appropriately set within a range of from 1200 to 175°.

The peripheral portion 16 to be finally cut out is formed in the vicinity of (a region B1 of) the target formed body 12. The peripheral portion 16 includes a first peripheral portion 16*a* formed in a region B3 retained by respective blank holders 24 and 34 (refer to FIGS. 2 and 3), and a second peripheral portion 16*b* that is formed in a region B2 supported by lower dies 22 and 32.

Figure 2:
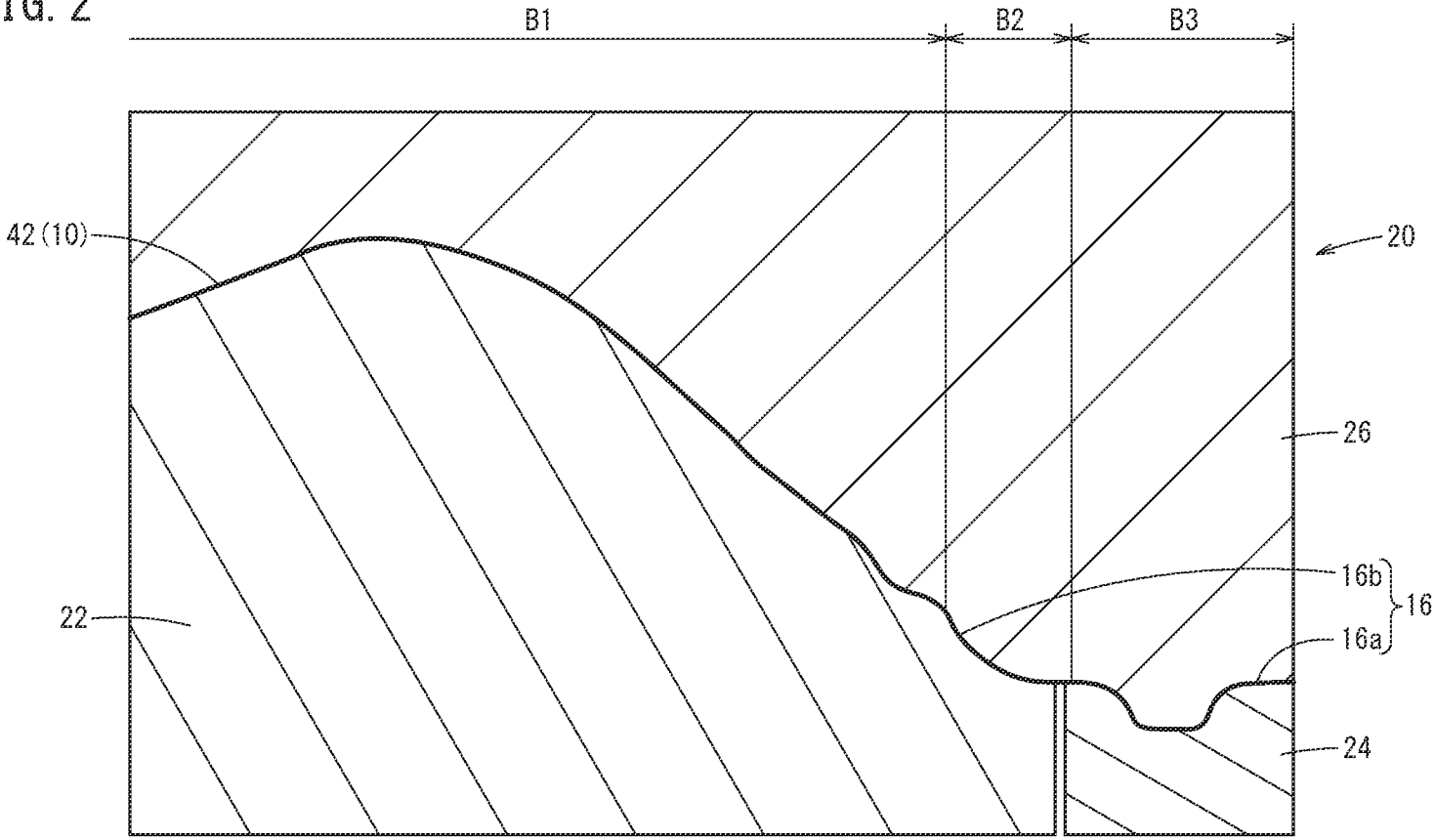
FIG. 2 is a cross-sectional view of a first step of the press forming method according to the embodiment.

In the first step shown in FIG. 2, an intermediate formed body 42 is press formed from the plate member 10 using a first upper die 26 and a first lower die 22. As shown in the drawing, a forming die 20 that is used in the first step is equipped with the blank holder 24 arranged in the region B3 on the lower side of the first peripheral portion 16*a* of the plate member 10, the first lower die 22 arranged in the regions B1 and B2 on an inner side of the blank holder 24, and the first upper die 26 arranged above the first lower die 22 and the blank holder 24.

In the first step, at first, the plate member 10 is carried in between the first lower die 22 and the blank holder 24, and the first upper die 26. Thereafter, the first upper die 26 is lowered, and while a tensile force is generated by retaining the first peripheral portion 16*a* by the blank holder 24, the plate member 10 is pressed by the first lower die 22 and the first upper die 26 to thereby form the intermediate formed body 42. It should be noted that the first step need not necessarily be performed by draw forming.

Figure 3:
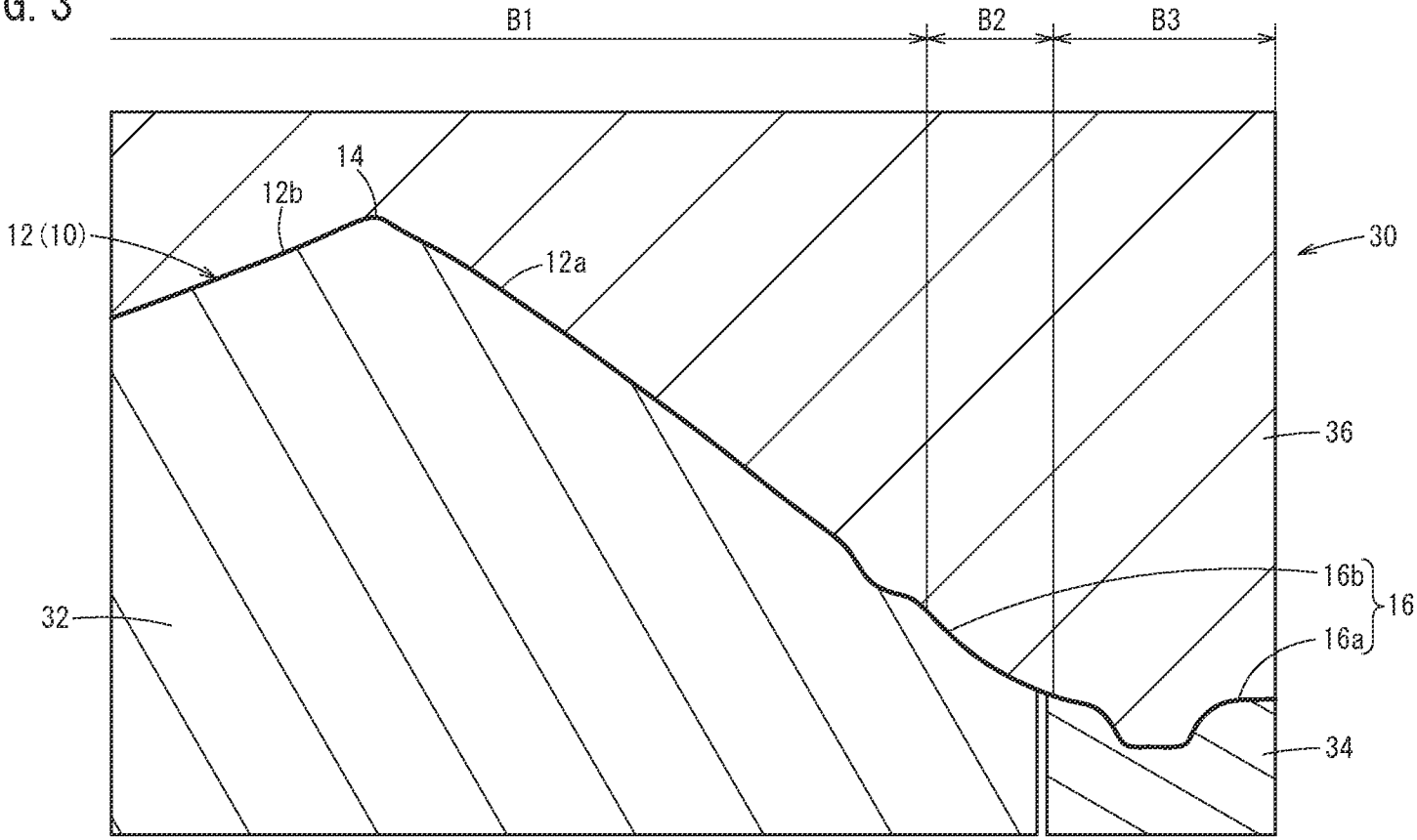
FIG. 3 is a cross-sectional view of a second step of the press forming method according to the embodiment.

Thereafter, in the second step shown in FIG. 3, the target formed body 12 is press formed from the intermediate formed body 42. As shown in the drawing, a forming die 30 that is used in the second step is equipped with the blank holder 34 arranged in the region B3 on the lower side of the first peripheral portion 16*a*, a second lower die 32 arranged in the regions B1 and B2 on an inner side of the blank holder 34, and a second upper die 36 arranged above the second lower die 32 and the blank holder 34.

In the second step, the intermediate formed body 42 is carried in between the second lower die 32 and the blank holder 34, and the second upper die 36. Thereafter, the second upper die 36 is lowered, and while a tensile force is generated by retaining the first peripheral portion 16*a* by the blank holder 34, the intermediate formed body 42 is pressed by the second lower die 32 and the second upper die 36 to thereby form the target formed body 12.

Figure 4:
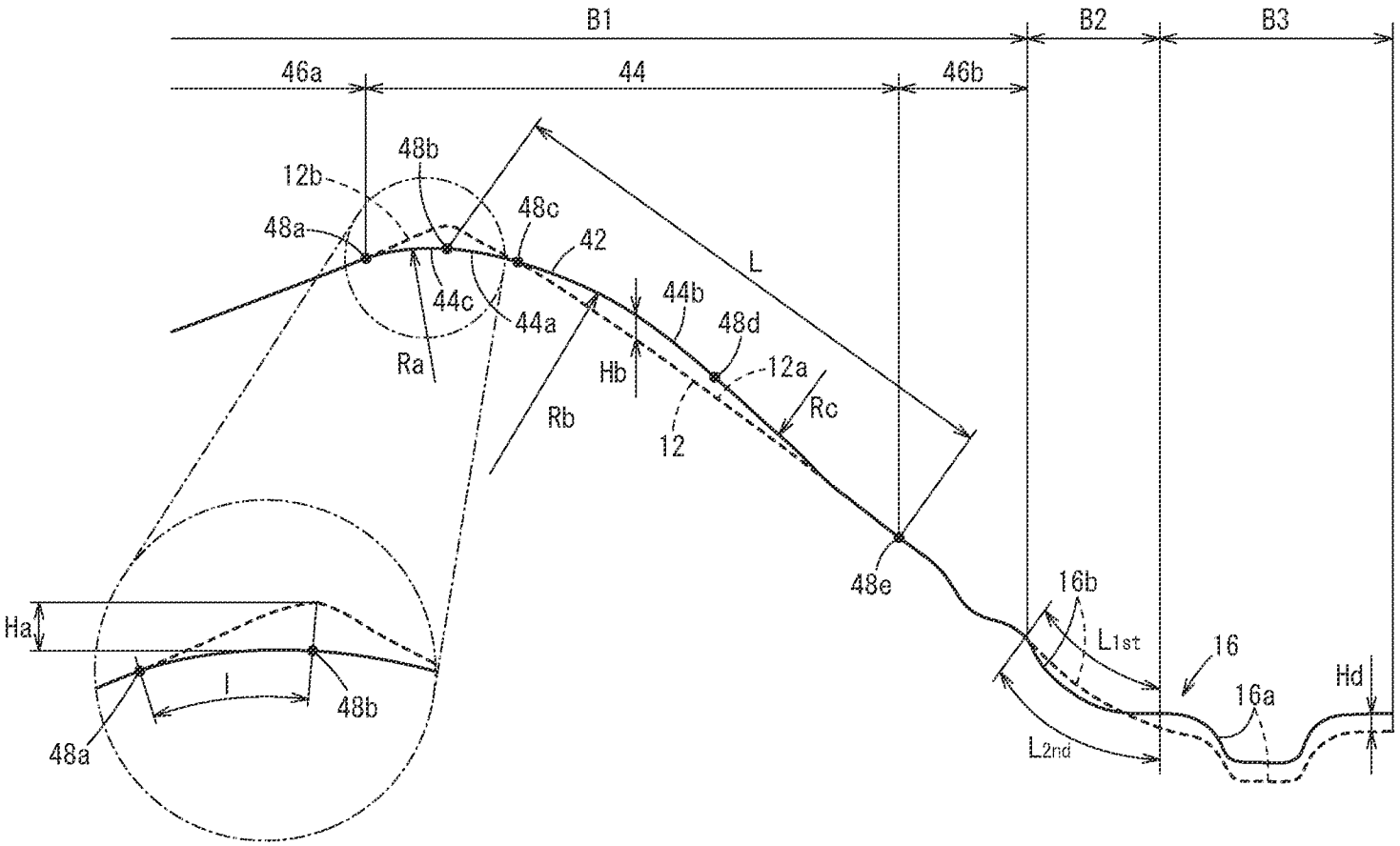
FIG. 4 is a cross-sectional view showing a state in which an intermediate formed body shown in FIG. 2, and the target formed body shown in FIG. 3 are superimposed in a manner so that respective regions thereof coincide with each other.

As shown in FIG. 4, when the intermediate formed body 42 and the target formed body 12 are superimposed on each other, an intermediate region 44 in which the shapes of the intermediate formed body 42 and the target formed body 12 differ from each other is formed in the portion shown by the dashed line. Further, in the peripheral portion 16 of the intermediate formed body 42 and the peripheral portion 16 of the target formed body 12 as well, the shapes thereof also differ from each other. On the other hand, coincident regions 46*a* and 46*b* in which the shapes of the intermediate formed body 42 and the target formed body 12 coincide are formed on both side portions of an intermediate ridgeline section 44*c* of the intermediate formed body 42.

Focusing attention on the intermediate region 44 of the intermediate formed body 42, the intermediate region 44 comprises an inside region 44*a* in which the intermediate formed body 42 is curved on the lower side (inwardly of the edge radius) in the press stroke direction than the target formed body 12, and an outside region 44*b* in which the intermediate formed body 42 projects more upward (outwardly of the edge radius) in the press stroke direction than the target formed body 12. The inside region 44*a* is formed within a range starting from an inflection point 48*a* of the second slope 12*b* until reaching an intersection 48*c* with the first slope 12*a*. The outside region 44*b* is formed within a range starting from the intersection 48*c* with the first slope 12*a* until reaching an inflection point 48*e*. As shown in the drawing, the length of the outside region 44*b* is formed to be longer than the length of the inside region 44*a*.

A cross-sectional shape of the intermediate region 44 of the intermediate formed body 42 is made up from a plurality of arcuate regions. In the illustrated example, a range extending from the inflection point 48*a* to a reference inflection point 48*b* is formed of a first arcuate region having a radius of curvature Ra. Further, a range extending from the reference inflection point 48*b* to an inflection point 48*d* is formed of a second arcuate region having a radius of curvature Rb. Furthermore, a range extending from the inflection point 48*d* to the inflection point 48*e* is formed of a third arcuate region having a radius of curvature Rc and having the center thereof on the outer side. Moreover, the range extending from the inflection point 48*a* to the reference inflection point 48*b*, and the range extending from the reference inflection point 48*b* to the inflection point 48*d* may be constituted by a plurality of arcuate regions having the same degree of curvature. Further, the third arcuate region need not necessarily be provided, and the second arcuate region may constitute a range extending from the reference inflection point 48*b* to the inflection point 48*e*.

In the intermediate formed body 42 of the intermediate region 44, the radius of curvature Rb of the second arcuate region is greater than the radius of curvature Ra of the first arcuate region. The radius of curvature Ra of the first arcuate region can be, for example, from 15 mm to 30 mm, the radius of curvature Rb of the second arcuate region can be, for example, from 40 mm to 60 mm, and the radius of curvature Rc of the third arcuate region can be greater than or equal to 40 mm. The length of the outside region 44*b* can be appropriately set depending on the size of the radius of curvature Rc of the third arcuate region.

Further, the reference inflection point 48*b* between the first arcuate region and the second arcuate region is formed in the vicinity of the ridgeline section 14 of the target formed body 12. In addition, the vicinity of the reference inflection point 48*b* serves as the intermediate ridgeline section 44*c* which projects maximally upward in the press stroke direction within the intermediate formed body 42. As shown in the partially enlarged view, the reference character 1 defines a length between the inflection point 48*a* and the reference inflection point 48*b* in a direction along the cross section of the intermediate formed body 42. Further, the reference character L defines a length between the reference inflection point 48*b* and the inflection point 48*e* in the direction along the cross section of the intermediate formed body 42. In the present embodiment, the intermediate formed body 42 is formed in a manner so that the inequality 1<L is satisfied. Although not particularly limited, for example, the length L can be less than or equal to 70 mm.

When a length along the cross section of the intermediate formed body 42 in the intermediate region 44 is defined by L0, and a length along the cross section of the target formed body 12 in the intermediate region 44 is defined by L1, it is preferable for the cross-sectional shape of the intermediate formed body 42 to be formed in a manner so that the rate of elongation ((L1−L0)/L0) becomes from 0 to 2%. Such a rate of elongation can be adjusted by the shape of the outside region 44*b* of the intermediate formed body 42.

Within the inside region 44*a*, when a maximum deviation of a portion where the deviation between the target formed body 12 and the intermediate formed body 42 in the press stroke direction (the vertical direction in the figure) becomes maximal is defined by Ha, and within the outside region 44*b*, when a maximum deviation of a portion where the deviation in the press stroke direction between the target formed body 12 and the intermediate formed body 42 becomes maximal is defined by Hb, the intermediate formed body 42 is formed in a manner so that the inequality Ha>Hb is satisfied. The maximum deviation Ha can be, for example, less than or equal to 3.1 mm, and the maximum deviation Hb is set to be less than or equal to the maximum deviation Ha.

On the other hand, focusing attention on the regions B2 and B3 in which the peripheral portions 16 are formed, the first peripheral portion 16*a* of the intermediate formed body 42 is formed at a position which is higher, by Hd, in the press stroke direction, than the first peripheral portion 16*a* of the target formed body 12. The height deviation Hd is provided in order to prevent the intermediate formed body 42 in the intermediate region 44 from coming into contact with the second upper die 36 and being deformed, when the intermediate formed body 42 is retained by the blank holder 34 in the second step (refer to FIG. 6). Accordingly, it is preferable for the intermediate formed body 42 to be formed in a manner so that the deviation Hd in the press stroke direction in the first peripheral portion 16*a* becomes greater than the maximum deviation Hb in the outside region 44*b*.

The second peripheral portion 16*b* in the region B2 is provided in order to absorb the deviation Hd in the press stroke direction between the first peripheral portion 16*a* of the intermediate formed body 42 and the first peripheral portion 16*a* of the target formed body 12, within a range up to the coincident region 46*b*. In the second step, in order so as not to pull on the intermediate region 44, a length $L_{1st}$ of the second peripheral portion 16*b* of the intermediate formed body 42, and a length $L_{2nd}$ of the second peripheral portion 16*b* of the target formed body 12 are set so as to be of approximately the same length. Moreover, in order to adjust the amount of pulling in the second step, the length $L_{1st}$ of the second peripheral portion 16*b* of the intermediate formed body 42 may be longer than the length $L_{2nd}$ of the second peripheral portion 16*b* of the target formed body 12. The value of $L_{2nd}-L_{1st}$ can be, for example, on the order of 0 to 0.05 mm.

Hereinafter, press forming in the second step and operations of the intermediate formed body 42 will be described with reference to FIGS. 5 to 8.

Figure 5:
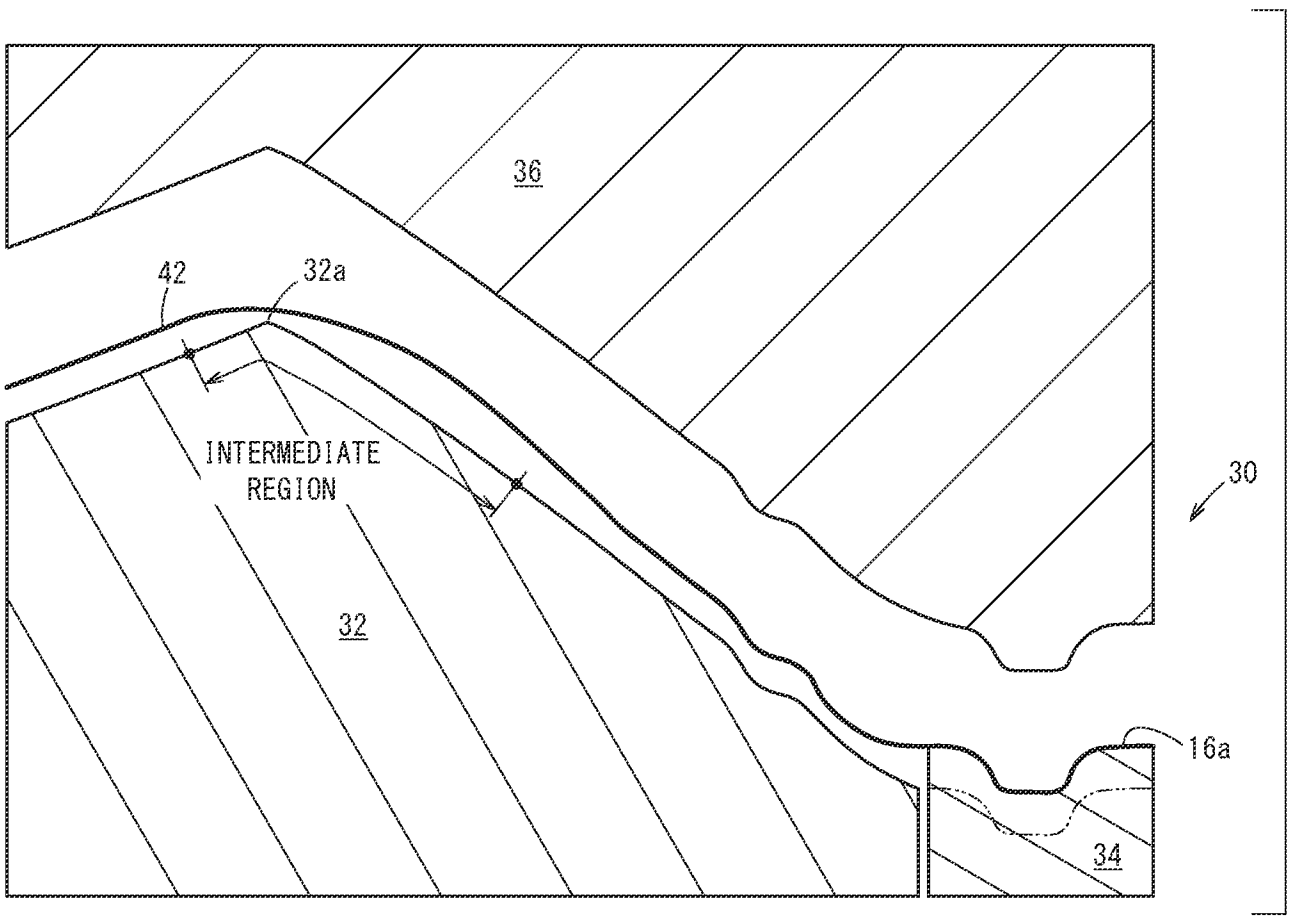
FIG. 5 is a cross-sectional view of a forming die used in the second step, at a standby position.

As shown in FIG. 5, in an initial state, the blank holder 34 projects more upward in the press stroke direction by a predetermined height than the second lower die 32. The blank holder 34 can be displaced so as to stop at the position of the lower end as indicated by the two-dot dashed line, by being pressed downward by the second upper die 36.

As shown in the drawing, the intermediate formed body 42 is carried in between the second lower die 32 and the blank holder 34, and the second upper die 36. Then, the first peripheral portion 16*a* is arranged and positioned on the blank holder 34.

Figure 6:
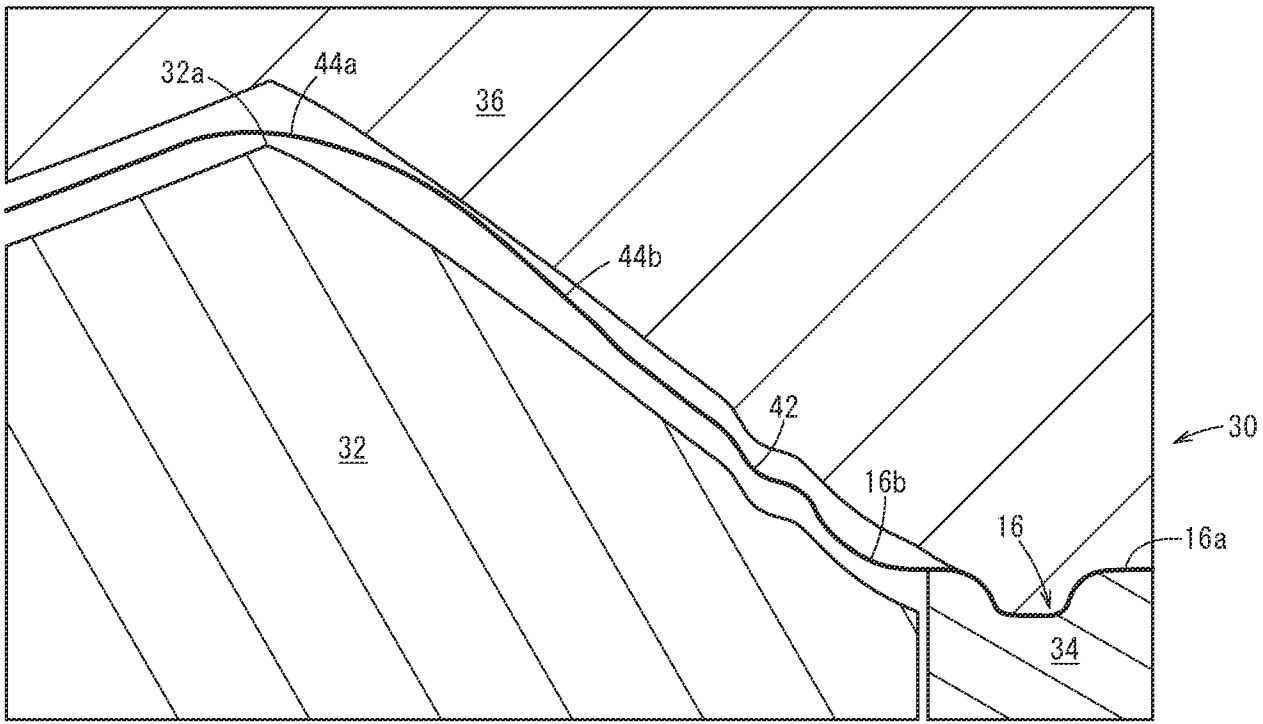
FIG. 6 is a cross-sectional view of the forming die used in the second step, at a blank holding position.

Thereafter, as shown in FIG. 6, when the second upper die 36 is subjected to a downward stroke, the second upper die 36 and the blank holder 34 come into contact with each other via the intermediate formed body 42. Then, the first peripheral portion 16*a* of the intermediate formed body 42 is sandwiched and retained by the blank holder 34 and the second upper die 36. As described previously, the first peripheral portion 16*a* of the intermediate formed body 42 is formed to be higher, by the deviation Hd, than the first peripheral portion 16*a* of the target formed body 12 (refer to FIG. 4). Therefore, even if the first peripheral portion 16*a* is retained by the blank holder 34 and the second upper die 36, the inside region 44*a* and the outside region 44*b* of the intermediate formed body 42 do not come into contact with the second upper die 36. Accordingly, when the intermediate formed body 42 is retained by the blank holder 34, it is possible to prevent the intermediate formed body 42 from moving while in contact with the second upper die 36, and thereby causing scratches to be generated on the design surface.

Figure 7:
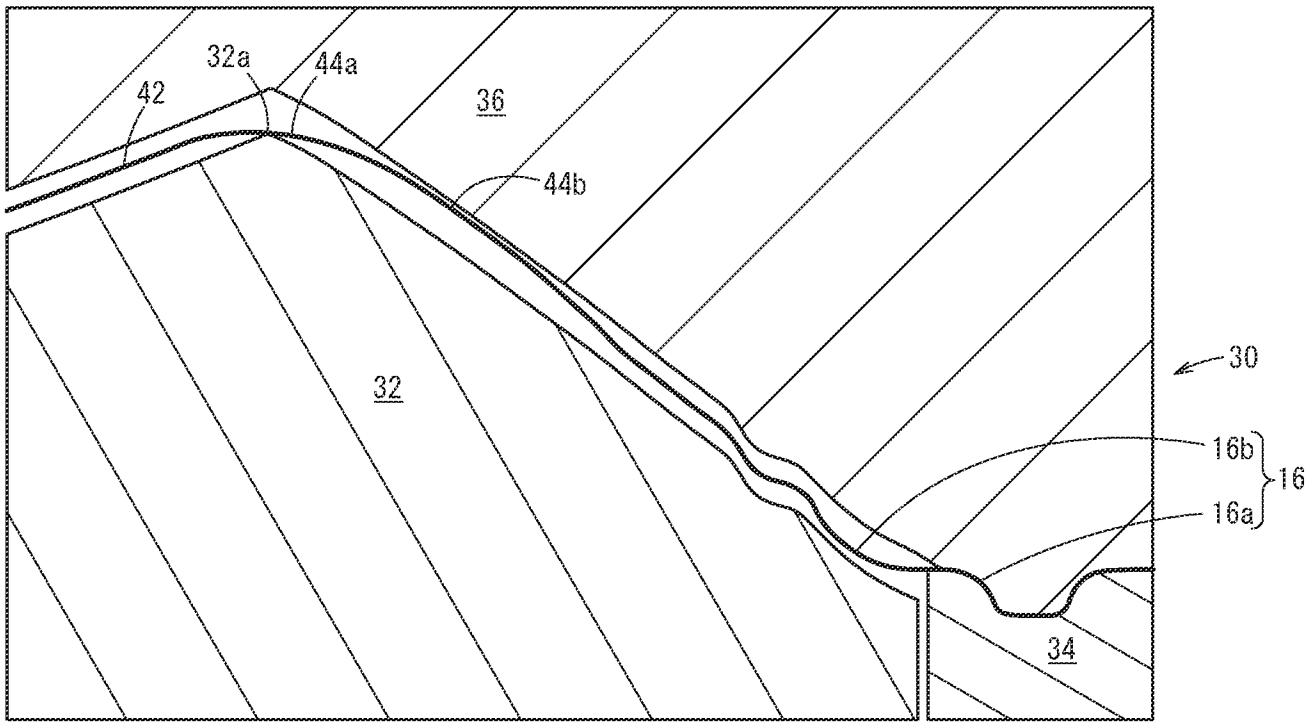
FIG. 7 is a cross-sectional view of the forming die used in the second step, during lowering thereof.

Thereafter, as shown in FIG. 7, the second upper die 36 is further lowered. Upon doing so, the inside region 44*a* comes into contact with ridgeline sections 32*a* of the second lower die 32, and is gradually deformed into the shape of the ridgeline sections 14 of the target formed body 12. Further, the outside region 44*b* is gradually deformed along the second lower die 32. Since the inside region 44*a* of the intermediate formed body 42 is curved inwardly of the ridgeline sections 14, the length thereof is insufficient to form the ridgeline sections 14 of the target formed body 12. Such an insufficiency is compensated for by the intermediate formed body 42 being moved from the outside region 44*b* to the inside region 44*a*. Further, since portions of the intermediate formed body 42 other than the intermediate region 44 are retained in a state of being suspended between the second lower die 32 and the second upper die 36, forming of the intermediate region 44 proceeds with precedence over that of the other portions. Consequently, it is possible to prevent excessive elongation from occurring in the vicinity of the ridgeline sections 14. Further, when the intermediate formed body 42 is subjected to deformation, a gap is formed between the design surface of the intermediate formed body 42 and the second upper die 36, and such a gap is maintained until just prior to the second upper die 36 reaching the bottom dead center.

Figure 8:
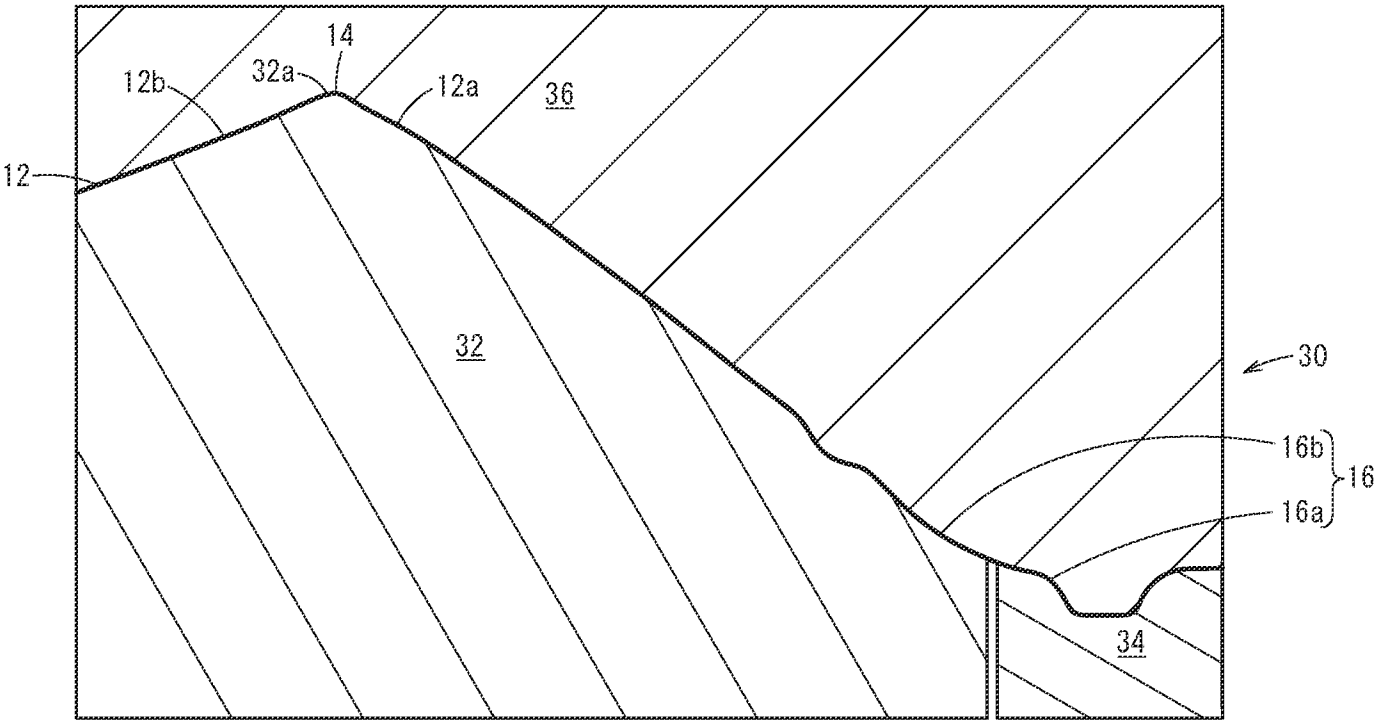
FIG. 8 is a cross-sectional view of the forming die used in the second step, at a bottom dead center.

Furthermore, as shown in FIG. 8, when the second upper die 36 is lowered, the entire area of the intermediate formed body 42 is sandwiched between the second lower die 32 and the second upper die 36, and forming of portions of the ridgeline sections 14 having a small radius of curvature is performed. According to the present embodiment, at a stage at which the inside region 44*a* and the outside region 44*b* are fully elongated, the entire region of the second lower die 32 and the second upper die 36 is closed. Therefore, when the ridgeline sections 14 with the small radius of curvature are formed, elongation of the intermediate formed body 42 is suppressed. As a result, the target formed body 12 can be formed while suppressing the occurrence of cracks in the vicinity of the ridgeline sections 14. The length L1 along the cross section of the target formed body 12 in the intermediate region 44 is slightly longer than the length L0 along the cross section of the intermediate formed body 42 in the intermediate region 44, and therefore, the intermediate region 44 of the intermediate formed body 42 is formed while being elongated at a predetermined rate of elongation.

The press forming method according to the present embodiment exhibits the following advantageous effects.

The press forming method according to the present invention is characterized by a press forming method for forming the plate member 10 into the target formed body 12 in which the ridgeline sections 14 are included, the press forming method comprising the first step of forming the intermediate formed body 42 including the intermediate ridgeline section 44*c* with a radius greater than an edge radius of the ridgeline sections 14, and the second step of forming the target formed body 12 from the intermediate formed body 42, wherein the target formed body 12 and the intermediate formed body 42 may each include the coincident regions 46*a* and 46*b* in which the cross-sectional shapes thereof coincide on both sides of the intermediate ridgeline section 44*c*, and the intermediate region 44 in which the cross-sectional shapes thereof do not coincide, and include, in the intermediate region 44, the outside region 44*b* in which the intermediate formed body 42 projects more outwardly of the edge radius than the target formed body 12, and the inside region 44*a* in which the intermediate formed body 42 is curved more inwardly of the edge radius than the target formed body 12. In the case of forming the target formed body 12 using the intermediate formed body 42 that is formed in this manner, when the ridgeline sections 14 having a small radius of curvature are formed, the intermediate formed body 42, which compensates for the insufficient length, can be provided from the outside region 44*b* toward the ridgeline sections 14. Consequently, the ridgeline sections 14 having such a small radius of curvature can be formed without causing the occurrence of scratches or cracks.

In the above-described press forming method, in the second step, an insufficiency in length when the inside region 44*a* is formed into the ridgeline sections 14 is compensated for by the intermediate formed body 42 in the outside region 44*b* being moved toward the ridgeline sections 14. In accordance with this feature, the ridgeline sections 14 can be formed without causing excessive elongation to occur. As a result, it is possible to prevent scratches and cracks from occurring in the ridgeline sections 14, and a press-formed product equipped with sharp ridgeline sections 14 having a small radius of curvature can be formed without causing the occurrence of surface distortion.

In the above-described press forming method, the length, in the cross-sectional direction, of the intermediate formed body 42 in the outside region 44*b* is longer than the length, in the cross-sectional direction, of the intermediate formed body 42 in the inside region 44*a*. In accordance with this feature, the intermediate formed body 42 having a sufficient length can be provided from the outside region 44*b* toward the ridgeline sections 14.

In the above-described press forming method, the intermediate region 44 of the intermediate formed body 42 is formed by a plurality of arcuate regions having different curvatures, and includes, in the vicinity of the position of the ridgeline sections 14 of the target formed body 12, the reference inflection point 48*b* that defines a boundary of the arcuate regions, and the length L of the intermediate region 44 on the side of the outside region 44*b* from the reference inflection point 48*b* is longer than the length 1 of the intermediate region 44 on the side opposite to the outside region 44*b* from the reference inflection point 48*b*. In accordance with such features, in the outside region 44*b*, which is in closer proximity to the peripheral portion 16 than the ridgeline sections 32*a* where elongation is likely to occur, the amount of material can be controlled, elongation in the ridgeline sections 14 of the target formed body 12 can be suppressed, and it is possible to prevent the occurrence of cracks in the ridgeline sections 14, as well as to prevent the occurrence of surface distortion of the outside region 44*b*.

In the above-described press forming method, the intermediate region 44 of the intermediate formed body 42 may include the first arcuate region that is curved inwardly of the target formed body 12 from one end of the intermediate region 44, and the second arcuate region that is connected to the first arcuate region at the reference inflection point 48*b* and is curved so as to project outwardly of the target formed body 12, wherein the radius of curvature Rb of the second arcuate region may be greater than the radius of curvature Ra of the first arcuate region.

In the above-described press forming method, the maximum deviation Ha in the press stroke direction between the intermediate formed body 42 and the target formed body 12 in the inside region 44*a* is greater than the maximum deviation Hb in the press stroke direction between the intermediate formed body 42 and the target formed body 12 in the outside region 44*b*. In accordance with this feature, in the second step, the second upper die 36 does not come into contact with the upper surface of the intermediate formed body 42, and the intermediate formed body 42 and the second lower die 32 do not come into contact with each other during blank holding. Therefore, it is possible to suppress generation of scratches due to slippage in a state in which the second lower die 32 and the second upper die 36 are placed in contact with the intermediate formed body 42, and the target formed body 12 which is devoid of scratches can be formed.

In the above-described press forming method, prior to pressing the ridgeline sections 14, the first step and the second step are performed in the forming dies 20 and 30 respectively including the blank holders 24 and 34 that retain the peripheral portion 16 of the plate member 10, and the outside region 44*b* of the intermediate formed body 42 is formed in a portion in closer proximity to the blank holder 34 than the ridgeline sections 14. In accordance with such features, on the side of the blank holder 34 where the tensile force is generated, elongation can be controlled, and surface distortion in closer proximity to the outer side of the ridgeline sections 14 can be prevented.

In the above-described press forming method, the first step and the second step are performed in the forming dies 20 and 30 respectively including the blank holders 24 and 34 that retain the peripheral portion 16 of the plate member 10, prior to pressing the ridgeline sections 14, and the height of the blank holder 34 in the second step is set to be higher than the height of the blank holder 24 in the first step, by at least the maximum deviation Hb in the press stroke direction between the intermediate formed body 42 and the target formed body 12 in the outside region 44*b*. In accordance with such features, in the second step, the second upper die 36 does not come into contact with the upper surface of the intermediate formed body 42, and the intermediate formed body 42 and the second lower die 32 do not come into contact with each other during blank holding. Therefore, it is possible to suppress generation of scratches due to slippage in a state in which the second lower die 32 and the second upper die 36 are placed in contact with the intermediate formed body 42, and the target formed body 12 which is devoid of scratches can be formed.

In the above-described press forming method, the length $L_{2nd}$ of the peripheral portion (second peripheral portion 16*b*) in the second step may be set to be longer than the length $L_{1st}$ of the peripheral portion (second peripheral portion 16*b*) in the first step.

In the above-described press forming method, the outer peripheral portion of the plate member 10 may be formed in a quadrangular shape constituted by the first side 10*a*, the second side 10*b* that faces toward the first side 10*a*, the third side 10*c* extending in a direction intersecting the first side 10*a*, and the fourth side 10*d* that faces toward the third side 10*c*, and the ridgeline sections 14 may be formed in the vicinity of the third side 10*c* and in the vicinity of the fourth side 10*d*, and extend from the first side 10*a* toward the second side 10*b*. In accordance with such a forming method, the sharp ridgeline sections 14 can be formed on a member such as the hood or the like of an automobile.

In the above-described press forming method, the inside region 44*a* of the intermediate formed body 42 may be formed inwardly of the ridgeline sections 14 of the target formed body 12, and the outside region 44*b* of the intermediate formed body 42 may be formed outwardly of the ridgeline sections 14 of the target formed body 12.

Although a description concerning the present invention has been given above with reference to a preferred embodiment, the present invention is not limited to the above-described embodiment, and it goes without saying that various modifications can be made thereto without departing from the essence and gist of the present invention.

What is claim is:

1. A press forming method for forming a plate member into a target formed body in which a ridgeline section is included, the press forming method comprising:

a first step of forming an intermediate formed body including an intermediate ridgeline section with a radius greater than an edge radius of the ridgeline section; and a second step of forming the target formed body from the intermediate formed body, wherein the target formed body and the intermediate formed body each include an intermediate region and coincident regions on both sides of the intermediate region, cross-sectional shapes of the target formed body and the intermediate formed body coincide in the coincident regions and do not coincide in the intermediate region, in the intermediate region, an outside region of the intermediate formed body projects more outwardly of the edge radius than the target formed body, and an inside region of the intermediate formed body is curved more inwardly of the edge radius than the target formed body, and a length, in a cross-sectional direction, of the intermediate formed body in the outside region is longer than a length, in the cross-sectional direction, of the intermediate formed body in the inside region.

2. The press forming method according to claim 1, wherein, in the second step, an insufficiency in length when the inside region is formed into the ridgeline section is compensated for by the intermediate formed body in the outside region being moved toward the ridgeline section.

3. The press forming method according to claim 1, wherein, prior to pressing the ridgeline section, the first step is performed in a forming die including a blank holder configured to retain a peripheral portion of the plate member, and the outside region of the intermediate formed body is formed in a portion in closer proximity to the blank holder than the ridgeline section.

4. The press forming method according to claim 3, wherein a height of the blank holder in the second step is set to be higher than a height of the blank holder in the first step, by at least a maximum deviation in a press stroke direction between the intermediate formed body and the target formed body in the outside region.

5. The press forming method according to claim 4, wherein a length of the peripheral portion in the second step is set to be longer than a length of the peripheral portion in the first step.

6. The press forming method according to claim 1, wherein an outer peripheral portion of the plate member is formed in a quadrangular shape constituted by a first side, a second side facing toward the first side, a third side extending in a direction intersecting the first side, and a fourth side facing toward the third side, and the ridgeline section is formed adjacent to the third side and the fourth side, and extends from the first side toward the second side.

7. The press forming method according to claim 1, wherein the inside region of the intermediate formed body is formed inwardly of the ridgeline section of the target formed body, and the outside region of the intermediate formed body is formed outwardly of the ridgeline section of the target formed body.

8. A press forming method for forming a plate member into a target formed body in which a ridgeline section is included, the press forming method comprising:

a first step of forming an intermediate formed body including an intermediate ridgeline section with a radius greater than an edge radius of the ridgeline section; and a second step of forming the target formed body from the intermediate formed body, wherein the target formed body and the intermediate formed body each include an intermediate region and coincident regions on both sides of the intermediate region, cross-sectional shapes of the target formed body and the intermediate formed body coincide in the coincident regions and do not coincide in the intermediate region, in the intermediate region, an outside region of the intermediate formed body projects more outwardly of the edge radius than the target formed body, and an inside region of the intermediate formed body is curved more inwardly of the edge radius than the target formed body, and the intermediate region of the intermediate formed body is formed by a plurality of arcuate regions having different curvatures, and includes, at a position of the ridgeline section of the target formed body, a reference inflection point that defines a boundary of the arcuate regions, and wherein a length of the intermediate region on a side of the outside region from the reference inflection point is longer than a length of the intermediate region on a side opposite to the outside region from the reference inflection point.

9. The press forming method according to claim 8, wherein the intermediate region of the intermediate formed body includes a first arcuate region that is curved inwardly of the target formed body from one end of the intermediate region, and a second arcuate region that is connected to the first arcuate region at the reference inflection point and is curved so as to project outwardly of the target formed body, and wherein a radius of curvature of the second arcuate region is greater than a radius of curvature of the first arcuate region.

10. A press forming method for forming a plate member into a target formed body in which a ridgeline section is included, the press forming method comprising:

a first step of forming an intermediate formed body including an intermediate ridgeline section with a radius greater than an edge radius of the ridgeline section; and a second step of forming the target formed body from the intermediate formed body, wherein the target formed body and the intermediate formed body each include an intermediate region and coincident regions on both sides of the intermediate region, cross-sectional shapes of the target formed body and the intermediate formed body coincide in the coincident regions and do not coincide in the intermediate region, in the intermediate region, an outside region of the intermediate formed body projects more outwardly of the edge radius than the target formed body, and an inside region of the intermediate formed body is curved more inwardly of the edge radius than the target formed body, and a maximum deviation in a press stroke direction between the intermediate formed body and the target formed body in the inside region is greater than a maximum deviation in the press stroke direction between the intermediate formed body and the target formed body in the outside region.

* * * * *